US010357139B2

(12) United States Patent
Werner et al.

(10) Patent No.: US 10,357,139 B2
(45) Date of Patent: Jul. 23, 2019

(54) TRAVELING FLOOR CLEANING MACHINE

(71) Applicant: Alfred Kärcher GmbH & Co. KG, Winnenden (DE)

(72) Inventors: Philipp Werner, Gaertringen (DE); Christian Egler, Weinstadt (DE); Frank Nonnenmann, Schorndorf (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 426 days.

(21) Appl. No.: 15/179,514

(22) Filed: Jun. 10, 2016

(65) Prior Publication Data

US 2016/0278598 A1 Sep. 29, 2016

Related U.S. Application Data

(63) Continuation of application No. PCT/EP2013/076358, filed on Dec. 12, 2013.

(51) Int. Cl.

| | |
|---|---|
| ***A47L 11/30*** | (2006.01) |
| ***A47L 11/40*** | (2006.01) |
| ***A47L 11/202*** | (2006.01) |
| ***A47L 11/24*** | (2006.01) |

(52) U.S. Cl.

CPC ..... *A47L 11/305* (2013.01); *A47L 11/2025* (2013.01); *A47L 11/24* (2013.01); *A47L 11/4002* (2013.01); *A47L 11/4016* (2013.01); *A47L 11/4038* (2013.01); *A47L 11/4066* (2013.01); *A47L 11/4083* (2013.01)

(58) Field of Classification Search

CPC ..... A47L 11/305; A47L 11/4083; A47L 11/4066; A47L 11/4016; A47L 11/24; A47L 11/2025; A47L 11/4038; A47L 11/4002

See application file for complete search history.

(56) References Cited

U.S. PATENT DOCUMENTS

2009/0078290 A1 3/2009 Addicks et al.

FOREIGN PATENT DOCUMENTS

| | | |
|---|---|---|
| CA | 2 255 290 | 6/2000 |
| CN | 2124953 | 12/1992 |
| CN | 2131446 | 5/1993 |
| CN | 2553006 | 5/2003 |
| CN | 1486154 | 3/2004 |
| CN | 101384380 | 3/2009 |
| CN | 103209630 | 7/2013 |
| DE | 196 44 570 | 5/1998 |
| JP | H05 161582 | 6/1993 |
| WO | WO 2012/065624 | 5/2012 |

*Primary Examiner* — David Redding

(74) *Attorney, Agent, or Firm* — Womble Bond Dickinson (US) LLP

(57) ABSTRACT

A traveling floor cleaning machine is provided, including a chassis, a cleaning tool apparatus which is arranged on the chassis with at least one cleaning tool and a holder for the at least one cleaning tool, and a suction apparatus which includes a suction unit and an aspiration apparatus, wherein the suction unit is arranged on the holder.

37 Claims, 5 Drawing Sheets

TRAVELING FLOOR CLEANING MACHINE

CROSS-REFERENCE TO RELATED APPLICATIONS

This application is a continuation of international application number PCT/EP2013/076358 filed on Dec. 12, 2013, which is incorporated herein by reference in its entirety and for all purposes.

BACKGROUND OF THE INVENTION

The invention relates to a traveling floor cleaning machine comprising a chassis, a cleaning tool apparatus which is arranged on the chassis and has at least one cleaning tool and a holder for the at least one cleaning tool, and a suction apparatus which comprises a suction unit and an aspiration apparatus.

From WO 2012/065624 A1, there is known a traveling floor cleaning device with at least one cleaning tool for cleaning a floor surface and with a cleaning fluid tank as well as with a dirty fluid tank and a suction unit for taking up a cleaning fluid applied to the floor surface and for transferring the cleaning fluid into the dirty fluid tank, wherein a first recess is formed into the tank wall of the cleaning fluid tank or the dirty fluid tank in which the suction unit is arranged and covered by a first covering element, wherein the tank wall and/or the first covering element form at least one air guidance channel which extends from the first recess to an opening.

In accordance with the present invention, a floor cleaning machine is provided, which is configurable compactly with a simply designed construction.

SUMMARY OF THE INVENTION

In accordance with an embodiment of the invention, the suction unit is arranged on the holder.

In accordance with an embodiment of the invention, the holder serves firstly to hold the at least one cleaning tool and secondly also to hold the suction unit. In this way, the floor cleaning machine can be configured compactly. The floor cleaning machine can be optimized with regard to its center of gravity.

The suction unit is relatively easily accessible due to the arrangement and, in particular, the direct arrangement on the holder, including for maintenance work or exchange operations.

In particular, the holder is configured as a hood and/or a covering for the at least one cleaning tool. Additionally, the number of components needed can be minimized.

Favorably, the suction unit comprises a suction blower and a blower motor. By this means, a suction flow can be created for a negative pressure application, in order to be able by means of the aspiration apparatus which comprises, in particular, one or more vacuum beams, to be able to aspirate excess fluid (dirty fluid).

In an advantageous embodiment, a motor apparatus for a movement drive and, in particular, a rotation drive of the at least one cleaning tool is also seated on the holder, wherein the at least one cleaning tool is moved relative to the holder. Resulting therefrom is an optimized use of space with minimization of the components needed. By this means also, the floor cleaning machine can be configured in a compact way.

In one exemplary embodiment, the at least one cleaning tool and the motor apparatus are arranged and configured so that on contact of the at least one cleaning tool with the floor, a travel drive of the floor cleaning machine is provided. The cleaning tool brings about a "friction drive" for the traveling floor cleaning machine.

Favorably, a tank apparatus with at least one cleaning fluid tank and at least one dirty fluid tank is arranged on the chassis. In this way, a stand-alone cleaning operation can be realized. Cleaning fluid from the at least one cleaning fluid tank can be applied to the floor to be cleaned and excess dirt-laden fluid can be taken up into the at least one dirty fluid tank of the floor cleaning machine.

It is particularly advantageous if at least one receptacle chamber for the suction unit and/or for a motor apparatus for the at least one cleaning tool is formed by a recess on the tank apparatus. A recess of this type can be realized in an easy way by wall formation of the tank apparatus. The receptacle chamber or chambers can easily be formed into the tank apparatus by suitable formation of a wall of the tank apparatus.

In one exemplary embodiment, it is provided that the at least one receptacle chamber is formed on the at least one cleaning fluid tank. It is advantageous, for example, if the dirty fluid tank is removable in order to be able to empty it easily. The at least one cleaning fluid tank can be arranged statically on the chassis. A positioning of the suction unit "in" the at least one cleaning fluid tank is then advantageous.

It is particularly advantageous if the at least one receptacle chamber (for the suction unit and/or for the motor apparatus) is formed directly above the holder, wherein a projection of the at least one receptacle chamber meets the holder downwardly. If, for example, the floor cleaning machine stands on a horizontal surface (relative to the direction of gravity), then a projection of the at least one receptacle chamber meets the holder in the vertical direction. By this means, a simple and compact structure for the floor cleaning machine results.

For a compact construction, it is favorable if the at least one receptacle chamber is spaced from the aspiration apparatus in a longitudinal direction of the floor cleaning machine, wherein in particular the battery apparatus and/or a wheel apparatus is arranged on the chassis between the at least one receptacle chamber and the aspiration apparatus. This results in a compact configuration. Optimized center of gravity conditions can be achieved for an operation.

It is further favorable if the at least one recess is open toward an underside of the chassis. In this way, the floor cleaning machine can be assembled easily. Furthermore, in this way, maintenance of the suction unit or the motor apparatus can easily be carried out and a simple exchange is possible.

It is favorable if the at least one recess (i.e. the at least one receptacle chamber) is configured as an indentation at a wall of the tank and particularly is correspondingly formed. The corresponding receptacle chamber can thereby be provided in a simple manner. Furthermore, one or more flow channels and also winding flow channels can be provided in a simple manner in order to be able to realize noise minimization by simple means.

It is favorable if an air guiding apparatus is provided which has one or more flow channels for air which are arranged at least partially in the at least one receptacle chamber and, in particular, the at least one receptacle chamber for the suction unit. Thus, in a constructionally simple manner, an air guidance can be achieved in order, for example, to be able to remove process (exhaust) air in a suitable way. The constructional effort and the sealing effort can be minimized.

In particular, through the air guiding apparatus, feed air and/or exhaust air for a blower motor of the suction unit and/or feed air and/or exhaust air for a motor apparatus for the at least one cleaning tool and/or process air of the suction unit can be guided.

It is particularly advantageous if a delimiting wall of the at least one receptacle chamber and/or of the tank apparatus at least partially forms a wall of one or more flow channels. By this means, flow channels can be formed by simple means with minimized constructional effort. The tank apparatus with its corresponding delimiting wall can be formed effectively as a counterelement for the flow guidance.

In one exemplary embodiment, a wall which is fluid-tight relative to the suction unit is arranged in the at least one receptacle chamber, wherein a flow-through chamber for air is formed between the wall and a delimiting wall of the at least one receptacle chamber. In this way, at least one flow channel by means of which, for example, process air is removable can be formed by simple means.

In one exemplary embodiment, a flow guidance element with at least one inlet and with at least one outlet is provided, wherein the flow guidance element forms and/or defines one or more flow channels with a curved flow guidance direction and/or a flow deflection.

By means of the flow guidance element, by simple means, a "curvature" of a main flow direction or a flow deflection, in particular for noise minimization, can be achieved.

It is particularly advantageous if the flow guidance element is placed on the holder and, in particular, is directly mounted thereon. By this means, a simply designed construction of the floor cleaning machine results.

In one exemplary embodiment, the flow guidance element comprises a middle element on which the suction unit is held and/or supported. An optimized flow guidance can thereby be achieved in a simple manner. For example, process (exhaust) air can be guided past the middle element in order to guide it away. For example, feed air can be guided over the middle element in particular to a blower motor of the suction unit and exhaust air can be guided away from the blower motor. This flow guidance can be realized by means of an integral component.

Favorably, at least one flow channel with a curved flow direction and/or a flow deflection is realized on the middle element. By this means, a flow guidance is provided on the floor cleaning machine.

In an exemplary embodiment, a first connector with an inlet is provided on the middle element. By this means, for example, feed air can be fed to the middle element, whereby this feed air is distributed by means of the middle element, for example, at a blower motor of the suction unit.

It is further favorable if a second connector with an outlet is arranged on the middle element. By means of the second connector, for example, exhaust air of a blower motor can be removed, wherein the removal then takes place by means of the middle element.

It is favorable if the first connector and the second connector are oriented transversely to one another. An optimized flow guidance results therefrom.

In particular, closed flow channels are formed in the first connector and/or the second connector. Then feed air and/or exhaust air for a blower motor can be guided in an optimized manner.

It is further favorable if an outlet web is arranged at the middle element, wherein particularly the outlet web forms a flow channel with a delimiting wall of a tank apparatus. By this means, an "integrated" flow guidance can be realized by means of the flow guidance element both for a cooling of the blower motor and also for the removal of process air. By positioning the outlet web to a delimiting wall region of the tank apparatus, the delimiting wall of the tank region can be used for forming one or more removal channels.

It is particularly advantageous if the flow element is formed in one piece. In this way, the floor cleaning machine can be manufactured easily.

In particular, the flow guidance element is configured for guiding process (exhaust) air of the suction unit and for guiding motor air and, in particular feed air and exhaust air of a motor apparatus for the at least one cleaning tool and/or of a blower motor for the suction unit. By this means, a simply designed construction of the floor cleaning machine with a minimization of the number of necessary components results.

In one exemplary embodiment, at least one channel is arranged at the at least one cleaning fluid tank, fluidically connected to the suction unit and is guided through the at least one cleaning fluid tank and is sealed against a receptacle chamber of the at least one cleaning fluid tank. An application of negative pressure to the aspiration apparatus can be achieved via this at least one channel.

In particular, the at least one channel is fluidically connected to a negative pressure application apparatus, by means of which negative pressure is applicable to a receptacle chamber of the at least one dirty fluid tank. By means of negative pressure application to the dirty fluid tank, an aspiration of dirty fluid can be "driven" at the aspiration apparatus.

In one exemplary embodiment, the suction apparatus comprises the suction unit which is seated on the holder, at least one channel which extends through a cleaning fluid tank, a negative pressure application apparatus which is fluidically connected via the at least one channel to the suction unit and by means of which negative pressure can be applied to a receptacle chamber of at least one dirty fluid tank and the aspiration apparatus with at least one vacuum beam which is fluidically connected to the receptacle chamber of the at least one dirty fluid tank. The negative pressure generated by the suction unit is provided via the at least one channel of the negative pressure application apparatus which in turn provides the necessary suction pressure in the receptacle chamber of the at least one dirty fluid tank. By means of the fluidic connection of the at least one dirty fluid tank to the aspiration apparatus, dirty fluid can be aspirated at the at least one vacuum beam.

Favorably, a delivery apparatus for delivering cleaning fluid onto the floor surface is arranged on the holder. The holder then has the function of holding the at least one cleaning tool, holding the suction unit and, if relevant, holding a motor apparatus for the cleaning tool including transferring the torque of the motor apparatus to the at least one cleaning tool as well as holding, for example, one or more nozzles for delivering cleaning fluid.

The floor cleaning machine according to the invention is configured, for example, as a scrubbing machine or a suction machine or a sweeping machine or a scrubbing-suction machine. It is configured, in particular, as a self-propelling machine for which an operator does not have to apply any bodily force for a travel drive.

In one exemplary embodiment, the floor cleaning machine according to the invention is configured as a walk-behind machine with which an operator walks behind the floor cleaning machine.

The following description of preferred embodiments serves to explain the invention in greater detail together with the drawings.

DETAILED DESCRIPTION OF THE INVENTION

Figure 1:
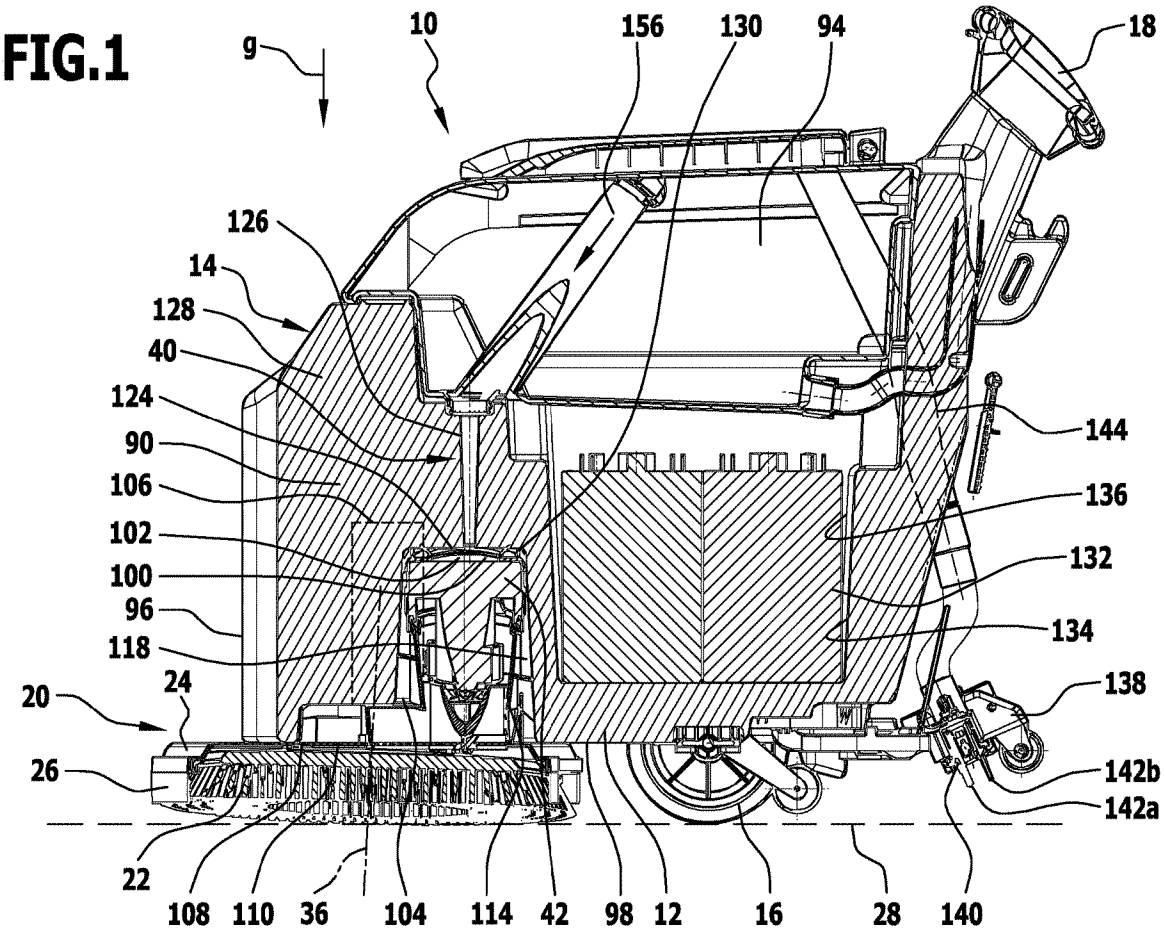
FIG. 1 is a sectional view of an exemplary embodiment of a floor cleaning machine according to the invention.
Figure 2:
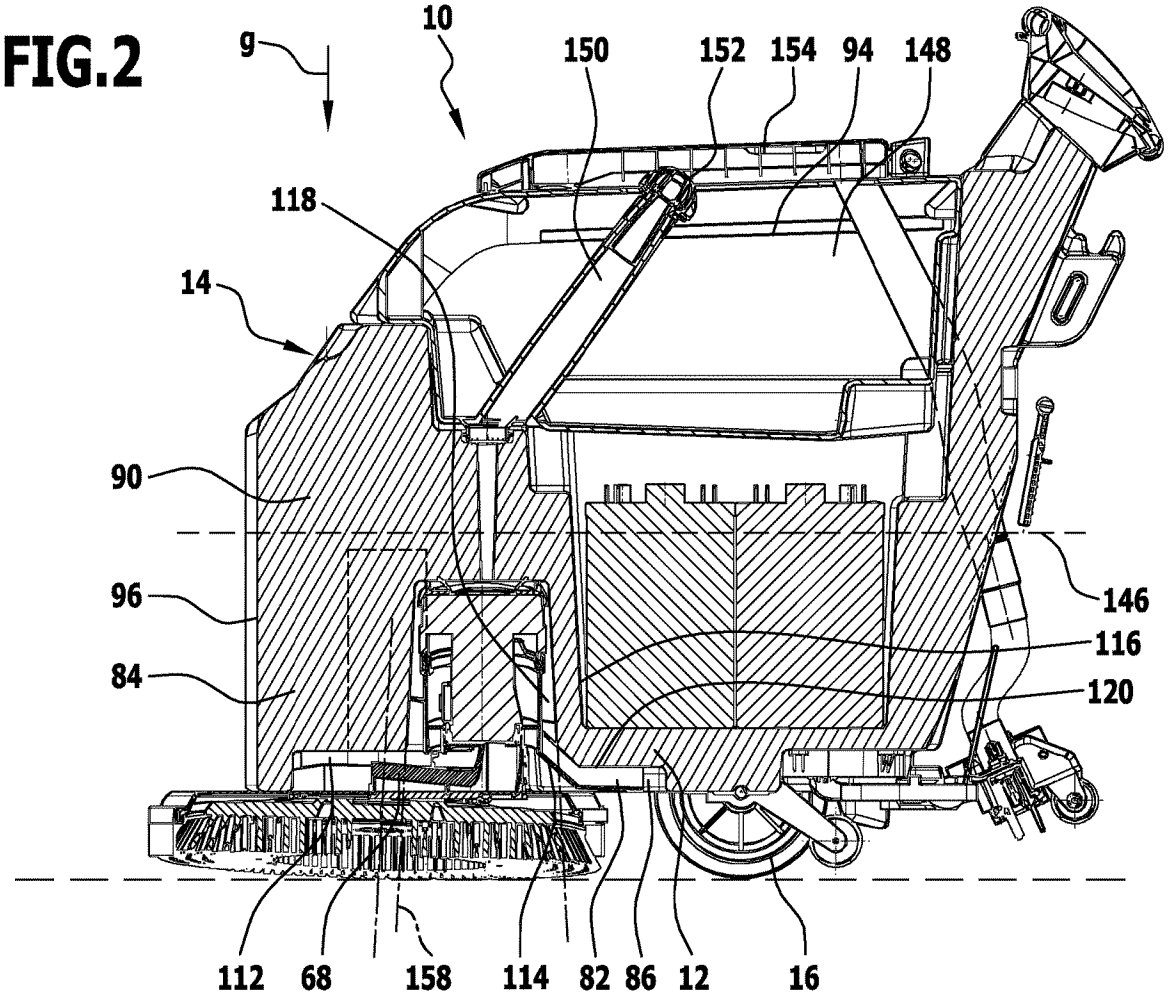
FIG. 2 is a further sectional view of the floor cleaning machine of FIG. 1.

An exemplary embodiment of a floor cleaning machine according to the invention, which is shown in FIGS. 1 and 2 and is identified therein as 10, comprises a chassis 12 on which a machine body 14 is arranged.

Arranged on the chassis is a wheel apparatus 16. The wheel apparatus 16 is steerable. For this purpose, a corresponding steering apparatus with a steering wheel 18 is provided.

The floor cleaning machine 10 comprises a cleaning tool apparatus 20 with at least one cleaning tool 22 which is arranged on a holder 24.

In the exemplary embodiment shown, the floor cleaning machine 10 is a scrubbing machine with a suction function (scrubbing-suction machine) and the cleaning tool 22 is a scrubbing brush.

The holder 24 is configured as a hood for the cleaning tool 22 which has an edge cover 26 for the cleaning tool 22.

The holder 24 is arranged on the chassis 12. By means of the holder, contact of the cleaning tool 22 with the floor is realized.

The traveling floor cleaning machine 10 is formed to be self-propelling.

In an exemplary embodiment, it is provided that the cleaning tool 22 is arranged at a small acute angle to a planar surface 28 (to the floor to be cleaned) by suitable arrangement of the holder 24 on the chassis 12. A travel propulsion of the floor cleaning machine 10 is brought about by the friction of the rotating cleaning tool 22 with the floor 28.

In particular, at least during cleaning operation, the floor cleaning machine 10 is supported on the floor 28 by means of the cleaning tool 22.

It can alternatively also be provided that the floor cleaning machine 10 comprises a front wheel apparatus and a travel drive for the front wheel apparatus which is arranged on the machine body 14.

In an exemplary embodiment (FIGS. 3 and 4), the cleaning tool 22 has a circle as the exterior contour. Accordingly, the holder 24 with its edge cover 26 is circular in cross-section.

The holder 24 comprises a receptacle chamber 30 for the cleaning tool 22. This receptacle chamber 30 is delimited laterally by the edge cover 26. It is covered upwardly by a (circular) disk 32. The receptacle chamber 30 is open toward the floor 28.

The cleaning tool apparatus 20 comprises a motor apparatus 34. A movement of the cleaning tool 22 is driven by means of the motor apparatus 34. This movement is, in particular, a rotation movement about a rotation axis 36 (FIG. 1).

The rotation axis 36 lies, if the floor cleaning machine 10 is placed, by means of the chassis 12, on a planar surface 28 which is horizontal relative to the gravitational direction g, at a slight acute angle to the vertical direction when the cleaning tool 22 is also used for travel drive.

The motor apparatus 34 comprises, for example, an electric motor 38. It can also comprise a gearing mechanism. This electric motor 38 drives a shaft in a rotation movement to which the cleaning tool 22 is connected rotationally fixed.

The motor apparatus 34 is arranged, in particular, in a central region of the disk 32 about the central point of the (circular) disk 32 and is held thereby. The motor apparatus 30 projects beyond the disk 32 in a direction which faces away from the receptacle chamber 30.

The floor cleaning machine 10 further comprises a suction apparatus identified overall as 40, through which fluid is aspiratable from the floor 28 to be cleaned. The suction apparatus 40 comprises a suction unit 42. The suction unit 42 itself comprises a suction blower 44 (FIG. 3) and a blower motor 46. By means of the suction unit 42, a suction flow (negative pressure flow) is generatable.

The suction unit 42 is seated on an upper side of the disk 32 on which the motor apparatus 34 for the cleaning tool 22 is also arranged. The suction unit is held or at least supported on the holder 24.

Figure 3:
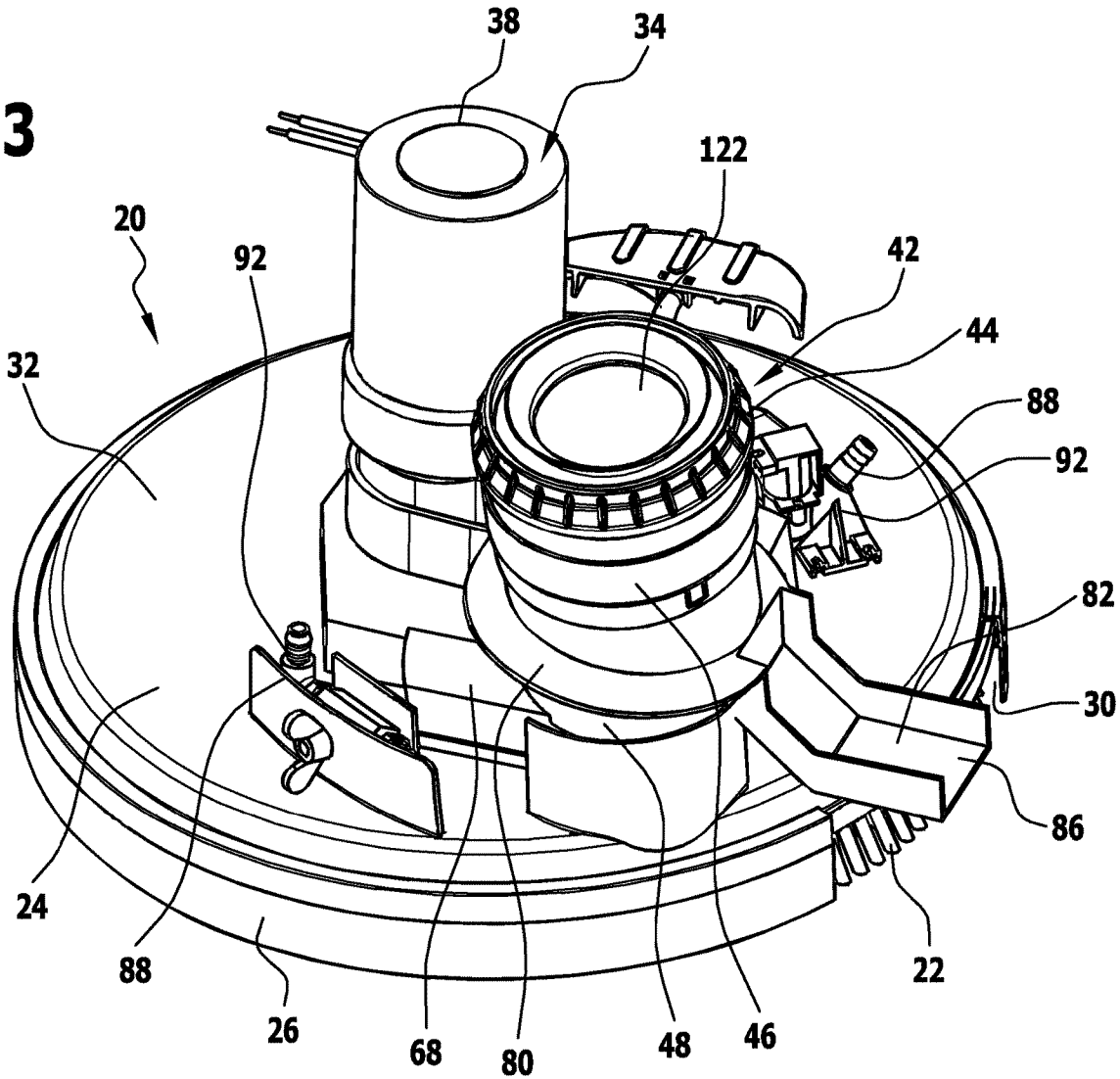
FIG. 3 is a top view of a cleaning tool apparatus of the floor cleaning machine of FIG. 1 with a suction unit arranged thereon.
Figure 4:
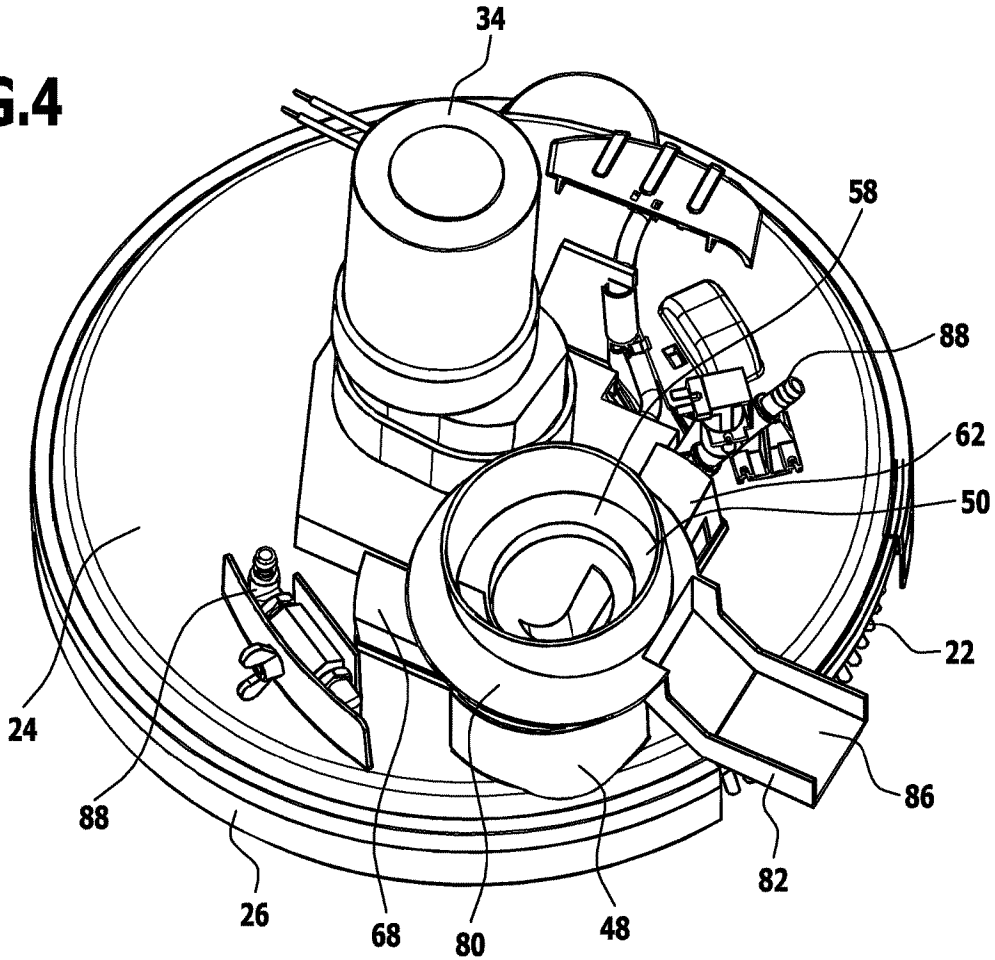
FIG. 4 is a similar view to FIG. 3 without the suction unit.
Figure 5:
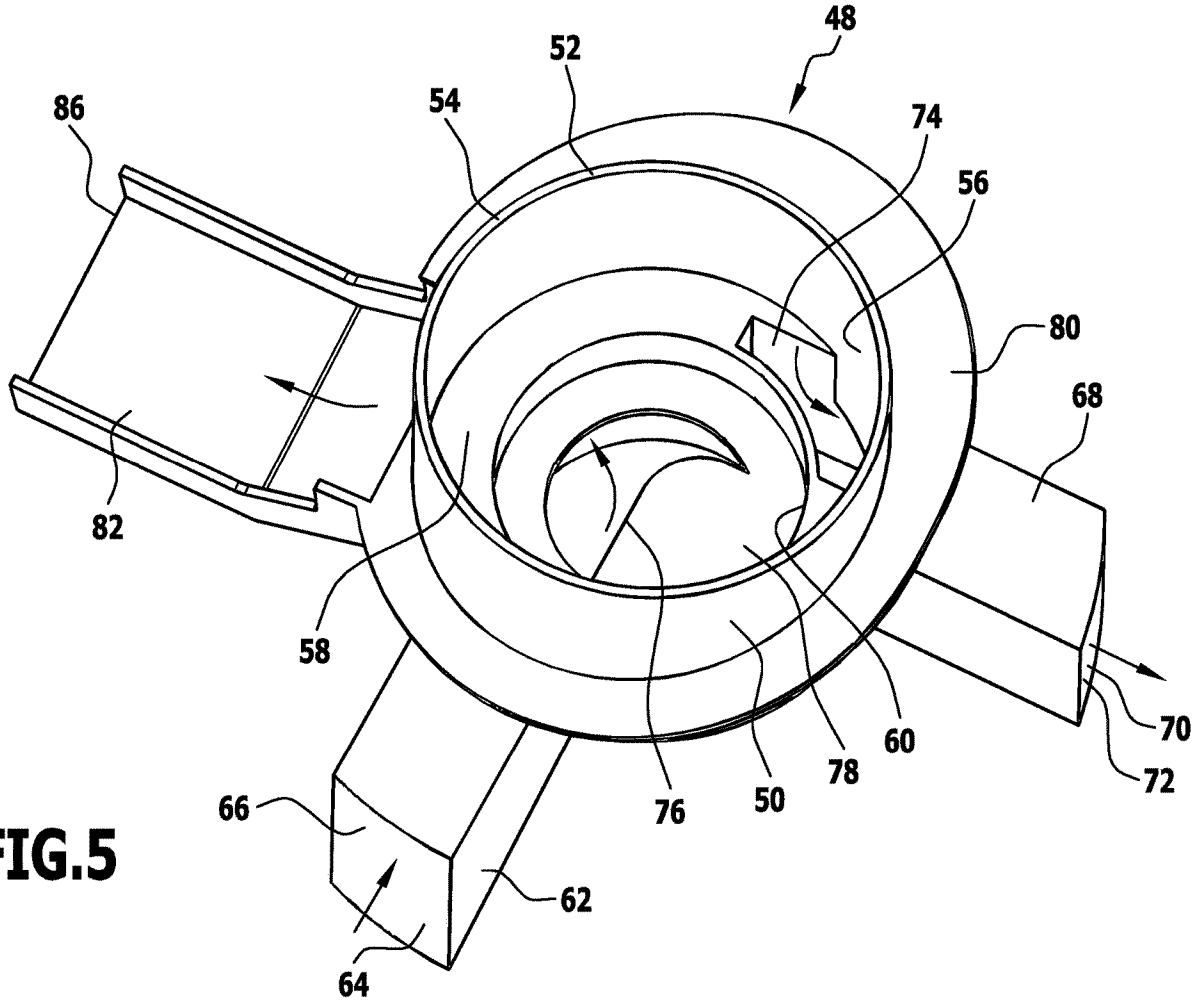
FIG. 5 is an exemplary embodiment of a flow guidance element (which is arranged on the cleaning tool apparatus of FIG. 3).

In an exemplary embodiment, a flow guidance element 48 is arranged on the disk 32 and, in particular, directly thereon (FIGS. 3 to 5).

The flow guidance element 48 forms a housing which receives the suction unit. The flow guidance element 48 is arranged on the disk 32 and the suction unit 42 is mounted in the housing.

It is also possible that both the suction unit and also the housing are mounted on the disk 32.

This flow guidance element 48 comprises a middle element 50. This middle element 50 has a cylindrical region 52. The cylindrical region 52 herein comprises a wall 54 which delimits an inner chamber 56.

Arranged in the inner chamber 56 transversely to the wall 54 is a support surface 58 which is, for example, annular. The support surface 58 delimits a, for example, cylindrical recess 60 which is arranged in the inner chamber 56.

The suction unit 42 is inserted into the cylindrical region 52 and the middle element 50 then serves as a holder or for supporting the suction unit 42.

A first connector 62 is seated on the middle element 50. The first connector 62 has an inlet 64 for air. In the first connector 62, starting from the inlet 64, a closed channel 66 is formed which opens into the inner chamber 56 beneath the support surface 58.

Furthermore, a second connector 68 with an outlet 70 for air is seated on the middle element 50. In the second connector 68, a closed channel 72 is formed which has an inlet in the inner chamber 56.

The first connector 62 and the second connector 68 are oriented transversely to one another and oriented, for example, at an angle of at least approximately 90° to one another. The first connector 62 and the second connector 68 form a type of tubes which project outwardly at the middle element 50.

An inlet 74 for the channel 72 which is arranged in the inner chamber 56 is positioned, in one exemplary embodiment, relative to an entry mouth at a different separation from the disk 32 than a corresponding outlet 76 of the channel 66 in the inner chamber 56.

In an exemplary embodiment, the recess 60 is delimited downwardly by a bottom 78 on which the outlet 76 is arranged. The inlet 74 is arranged on the support surface 58 which is spaced from the bottom 78.

An air flow which enters via the inlet 64 into the channel 66 and from the outlet 76 enters into the inner chamber 56 is guided in the inner chamber 56 and thereby also guided at a wall of the suction unit 42. Feed air is thereby guided to the blower motor 46. Exhaust air of the blower motor 46 is coupled in via the inlet 74 into the channel 68 and conducted away.

The flow guidance to and/or in the inner chamber 56 is therein such that a flow deflection takes place or that a main flow direction is not a linear direction, but has a curvature. This also contributes to a noise damping.

Arranged on the middle element 50 at an exterior side is an annular web 80 which surrounds the cylindrical region 52 of the middle element 50 and leads to an outlet web 82. The outlet web 82 leads away from the middle element 50 and forms a part of a flow guidance. The annular web 80 thereby downwardly delimits a flow channel. Process air can be coupled out of the suction unit 42 and removed via the outlet web 82. As described in greater detail below, herein closed flow channels are formed with the aid of a tank apparatus 84.

In an exemplary embodiment, the outlet web 82 lies opposite the second connector 68 and is arranged, for example, parallel or at least approximately parallel thereto.

The outlet web 82 forms an outlet mouth 86 which projects beyond the holder 24 and is spaced from the disk 32 and/or the edge cover 36.

The first connector 62 and the second connector 68 abut on the disk 32 and are, in particular, fixed thereon (FIGS. 3 and 4).

The middle element 50 is formed for example in one piece.

A delivery apparatus 88 for cleaning fluid is arranged on the holder 24. This delivery apparatus 88 comprises, for example, one or more nozzles through which the cleaning fluid is bringable into the receptacle chamber 30 and thus onto the floor 28. These cleaning nozzles are in fluidic connection to a cleaning fluid tank 90 of the tank apparatus 84.

In an exemplary embodiment, two nozzles 92 are provided which are spaced apart. In particular, the flow guidance element 48 and the motor apparatus 34 are arranged between the spaced nozzles 92.

An apparatus can be provided by means of which the cleaning tool apparatus 20 is liftable and/or lowerable relative to the floor 28.

In a cleaning operation, the cleaning tool 22 is then lowered onto the floor 28 to be cleaned.

The tank apparatus 84 is arranged on the machine body 14. It comprises the cleaning fluid tank 90 and a dirty fluid tank 94.

In an exemplary embodiment, the cleaning fluid tank 90 is arranged within a housing 96 of the floor cleaning machine 10.

The chassis 12 has an underbody 98 which faces the floor 28 on which the floor cleaning machine 10 stands. In one exemplary embodiment, the cleaning fluid tank 90 is arranged directly on the underbody 98.

In an exemplary embodiment, a first receptacle chamber 100 is formed on the cleaning fluid tank 90 in which the suction unit 42 lies. This receptacle chamber 100 is configured as a recess 102 in the cleaning fluid tank 90 which recess is an indentation on a wall 104 of the cleaning fluid tank 90.

This recess 102 has, for example, at least approximately the form of a (hollow) cylinder.

In an exemplary embodiment, provided spaced from the first receptacle chamber 100 is a second receptacle chamber 106 in which the motor apparatus 34 is arranged. This second receptacle chamber 106 is also formed by a recess which is an indentation on the wall 104 of the cleaning fluid tank 90.

It can also be provided that the motor apparatus 34 and the suction unit 42 are arranged in a common receptacle chamber.

The first receptacle chamber and the second receptacle chamber 106 are open toward an underside 108 of the chassis 12. The underbody 98 has an opening 110 at the first receptacle chamber 100 and the second receptacle chamber 106. In an exemplary embodiment, the opening 110 is a common opening for the first receptacle chamber 100 and the second receptacle chamber 106.

The second receptacle chamber 106 also has, for example, at least approximately the form of a (hollow) cylinder.

It can also be provided that, in particular, in the region of the second receptacle chamber 106, a third receptacle chamber 112 is provided in which further elements of the cleaning tool apparatus 20 and, in particular, the flow guidance element 48 are arranged.

In particular, the third receptacle chamber 112 is in direct contact with the first receptacle chamber 100 and the second receptacle chamber 106.

The holder 24 is arranged on the chassis 12 to be rotationally fixed.

A wall 114 which is sealed relative to the suction unit 42 is arranged in the first receptacle chamber 100 (FIGS. 1 and 2). Formed between this wall 114 and a delimiting wall 116 of the first receptacle chamber 100 at the cleaning fluid tank 90 are one or more flow channels 118. The flow channel or channels 118 lead to the outlet web 82. This, in turn, together with a further delimiting wall region 120 of the cleaning fluid tank 90, forms a continuation and thus a closed flow channel. The delimiting wall 116 and the delimiting wall 120 of the cleaning fluid tank 90 then form corresponding walls of one or more flow channels 118 by means of which the process (exhaust) air can be conducted away and can be released at the outlet mouth 86 to the surroundings.

The outlet mouth 86 is herein positioned at the underside 108 of the chassis 12.

The suction unit 42 has a suction inlet 122 to which, during suction operation, negative pressure is applied. This suction inlet 122 lies, in particular at an upper side of the suction unit 42 and faces a delimiting wall region 124 which is at least approximately parallel to the disk 32 of the cleaning tool apparatus 20.

(At least) one channel 126 opens into the suction inlet 122. This channel 126 is a suction channel. The channel 126 is guided through the cleaning fluid tank 90 and has, for example, when the floor cleaning machine 10 is placed on a floor 28 which is horizontal relative to the gravitational direction g, an at least approximately vertical orientation. The channel 126 is sealed relative to a receptacle chamber 128 of the cleaning fluid tank 90 for cleaning fluid.

A sealing apparatus 130 is arranged in the first receptacle chamber 100 in the region of the delimiting wall region 124.

A battery apparatus 132 which comprises, in particular, one or more rechargeable batteries is arranged on the machine body 14. The motor apparatus 34 and the blower motor 46 are suppliable with electric current by means of the battery apparatus 132.

In one exemplary embodiment, the battery apparatus 132 lies over the wheel apparatus 16.

It can be provided that the cleaning fluid tank 90 has an indentation 134 which defines a receptacle chamber 136 for the battery apparatus 132.

The dirty fluid tank 94 is seated on the cleaning fluid tank 90 and at least in a subregion, above the cleaning fluid tank 90. The dirty fluid tank 94 is, in particular, removable from the machine body 14.

An aspiration apparatus 138 is arranged on the chassis. The aspiration apparatus comprises a vacuum beam 140 with spaced apart suction lips 142*a*, 142*b*.

The vacuum beam 140 is arranged fixably movable on the chassis 12 and, for example, pivotable. It can be brought into a use position in which the suction lips 142*a*, 142*b* are placed on the floor 28.

In FIGS. 1 and 2, a position is shown which is a non-operative position wherein the suction lips 142*a*, 142*b* are spaced from the floor 28 to be cleaned.

By means of the vacuum beam 140, when it is in its operative position, fluid can be aspirated. For this purpose, a suction connection 144 to the dirty fluid tank 94 is created. An application of negative pressure to the vacuum beam 140 for aspirating fluid can be achieved via the dirty fluid tank 94.

The cleaning tool apparatus 20 is arranged in the region of a front end of the floor cleaning machine 10. The aspiration apparatus 138 with the vacuum beam 140 is arranged in the region of a rear end of the chassis 12, relative to a forward travel direction. The aspiration apparatus 138 and the cleaning tool apparatus 20 are spaced apart in a longitudinal direction 146 of the chassis 12 or the machine body 14. The wheel apparatus 16 is arranged between the holder 23 and the vacuum beam 140. Further, the battery apparatus is arranged, relative to the longitudinal direction 146, between the holder 24 with the cleaning tool 20 and the vacuum beam 140.

The dirty fluid tank 94 has a receptacle chamber 148 for dirty fluid. The suction connection 144 with the aspiration apparatus 138 opens into this receptacle chamber 148 by means of a corresponding connection.

Arranged in the receptacle chamber 148 is a tube 150 which has a suction inlet 152. The channel 126 is fluidically connected to the tube 150. A suction flow which is generated by the suction unit 42 brings about a negative pressure application to the suction inlet 152, wherein at the suction inlet 152, by means of a corresponding configuration, no fluid or only slight quantities can flow into the tube 150. (The sealing apparatus 130 prevents the ingress of any fluid that is in fact aspirated into the channel 126 to the suction unit 42.)

Furthermore, arranged at the machine body is a negative pressure application apparatus 154 which is positioned above the receptacle chamber 148.

Thus the receptacle chamber 148 allows a negative pressure to be generated via the connection of the channel 126 to the suction unit 42, which brings about an aspiration of fluid by means of the aspiration apparatus 138.

Through the tube 150, suction air 156 (which is dry or at most has a very low fluid content) flows through the channel 126. The corresponding process air is conducted away via the flow channel or channels 118.

The floor cleaning machine according to the invention 10 functions as follows:

In one exemplary embodiment, the floor cleaning machine 10 is configured as a walk-behind machine. An operator walks behind the machine, that is, he stands behind that end of the floor cleaning machine 10 at which the vacuum beam 140 is arranged. Steering and other operation is performed by means of the steering wheel 18.

During a cleaning operation, the vacuum beam 140 is lowered onto the floor 28. Furthermore, the cleaning tool 22 is lowered onto the floor 28.

The cleaning tool 22 rotates, driven by means of the motor apparatus 34. Cleaning fluid from the cleaning fluid tank 90 is applied to the floor 28. Dirt is loosened by the rotating cleaning tool 22. When a corresponding region is traveled over, excess liquid is aspirated by the vacuum beam 140 into the dirty fluid tank 94.

The negative pressure required therefor is provided by the suction unit 42 with the suction blower 44 driven by the blower motor 46.

The suction unit 42 and the motor apparatus 34 are arranged on the holder 24 for the cleaning tool 22 and herein held by the holder 24. They are, in particular, mounted on the holder 24.

The motor apparatus 34 and the suction unit 42 are arranged in the first receptacle chamber 100 and the second receptacle chamber 106 which are configured as indentations on the cleaning fluid tank 90. The first receptacle chamber 100 and the second receptacle chamber 106 can therein form a common receptacle chamber. In particular, the first receptacle chamber 100 and the second receptacle chamber 106 are formed into the cleaning fluid tank 90 by suitable configuration of the delimiting wall of the cleaning fluid tank 90 in the region of these receptacle chambers 100, 106.

A downward projection of the first receptacle chamber 100 and of the second receptacle chamber 106 lies on the holder 24. This projection is indicated in FIG. 2 by the reference sign 158. The first receptacle chamber 100 and the second receptacle chamber 126 herein lie directly above the holder 24.

By this means, a compact structure of the floor cleaning machine 10 results.

An optimized center of gravity configuration can be achieved.

The first receptacle chamber 100 forms, with a delimiting wall of the cleaning fluid tank 90, one or more flow channels 118, in particular, for removal of process air of the suction unit 42. In this way, the floor cleaning machine 10 can be realized with a simple design. A flow deflection can be achieved by easy means and a curved or winding flow guidance can be achieved in order to achieve noise minimization.

By means of the flow guidance element 48, air feed to and air removal from the blower motor 46 or the motor apparatus 34 can also be achieved easily and effectively integrated into the flow guidance for process air.

REFERENCE SYMBOL LIST

10 Floor cleaning machine
12 Chassis
14 Machine body
16 Wheel apparatus
18 Steering wheel
20 Cleaning tool apparatus
22 Cleaning tool
24 Holder
26 Edge cover
28 Floor
30 Receptacle chamber

32 Disk
34 Motor apparatus
36 Rotation axis
38 Electric motor
40 Suction apparatus
42 Suction unit
44 Suction blower
46 Blower motor
48 Flow guidance element
50 Middle element
52 Cylindrical region
54 Wall
56 Inner chamber
58 Support surface
60 Recess
62 First connector
64 Inlet
66 Channel
68 Second connector
70 Outlet
72 Channel
74 Inlet
76 Outlet
78 Floor
80 Annular web
82 Outlet web
84 Tank apparatus
86 Outlet mouth
88 Delivery apparatus
90 Cleaning fluid tank
92 Nozzle
94 Dirty fluid tank
96 Housing
98 Underbody
100 First receptacle chamber
102 Recess
104 Wall
106 Second receptacle chamber
108 Underside
110 Opening
112 Third receptacle chamber
114 Wall
116 Delimiting wall
118 Flow channel
120 Delimiting region
122 Suction inlet
124 Delimiting wall region
126 Channel
128 Receptacle chamber
130 Sealing apparatus
132 Battery apparatus
134 Indentation
136 Receptacle chamber
138 Aspiration apparatus
140 Vacuum beam
142*a* Suction lip
142*b* Suction lip
144 Suction connection
146 Longitudinal direction
148 Receptacle chamber
150 Tube
152 Suction inlet
154 Negative pressure application apparatus
156 Suction air
158 Projection

The invention claimed is:

1. A traveling floor cleaning machine comprising:
a chassis;
a cleaning tool apparatus which is arranged on the chassis, with at least one cleaning tool and with a holder for the at least one cleaning tool; and
a suction apparatus which comprises a suction unit and an aspiration apparatus;
wherein the suction unit is arranged on the holder;
wherein a tank apparatus with at least one cleaning fluid tank and with at least one dirty fluid tank is arranged on the chassis.

2. The traveling floor cleaning machine as claimed in claim 1, wherein the holder is configured as at least one of a hood and a covering for the at least one cleaning tool.

3. The traveling floor cleaning machine as claimed in claim 1, wherein the suction unit comprises a suction blower and a blower motor.

4. The traveling floor cleaning machine as claimed in claim 1, wherein a motor apparatus for a movement drive of the at least one cleaning tool is arranged on the holder, and wherein the at least one cleaning tool is moved relative to the holder.

5. The traveling floor cleaning machine as claimed in claim 4, wherein the at least one cleaning tool and the motor apparatus are arranged and configured so that on contact of the at least one cleaning tool with a floor, a travel drive of the floor cleaning machine is provided.

6. The traveling floor cleaning machine as claimed in claim 1, wherein at least one receptacle chamber for at least one of the suction unit and a motor apparatus for the at least one cleaning tool is formed by at least one recess on the tank apparatus.

7. The traveling floor cleaning machine as claimed in claim 6, wherein the at least one receptacle chamber is formed on the at least one cleaning fluid tank.

8. The traveling floor cleaning machine as claimed in claim 6, wherein the at least one receptacle chamber is formed directly above the holder, and wherein a projection of the at least one receptacle chamber lies downwardly on the holder.

9. The traveling floor cleaning machine as claimed in claim 6, wherein the at least one receptacle chamber is spaced from the aspiration apparatus in a longitudinal direction of the floor cleaning machine.

10. The traveling floor cleaning machine as claimed in claim 6, wherein the at least one recess is open toward an underside of the chassis.

11. The traveling floor cleaning machine as claimed in claim 6, wherein the at least one recess is configured as an indentation at a wall of the tank apparatus.

12. The traveling floor cleaning machine as claimed in claim 1, said traveling floor cleaning machine comprising an air guiding apparatus which has one or more flow channels for air and which are arranged at least partially in the at least one receptacle chamber.

13. The traveling floor cleaning machine as claimed in claim 9, wherein through the air guiding apparatus, at least one of (i) at least one of feed air and exhaust air for a blower motor of the suction unit, (ii) at least one of feed air and exhaust air for a motor apparatus for the at least one cleaning tool, and (iii) process air of the suction unit is guided.

14. The traveling floor cleaning machine as claimed in claim 12, wherein a delimiting wall of at least one of the at least one receptacle chamber and the tank apparatus at least partially forms a wall of one or more flow channels.

15. The traveling floor cleaning machine as claimed in claim 1, wherein a wall which is fluid-tight relative to the suction unit is arranged in the at least one receptacle chamber, and at least one flow-through chamber for air is formed between the wall and a delimiting wall of the at least one receptacle chamber.

16. The traveling floor cleaning machine as claimed in claim 1, said traveling floor cleaning machine comprising a flow guidance element with at least one inlet and with at least one outlet, wherein the flow guidance element comprises one or more flow channels with at least one of a curved flow guidance direction and a flow deflection.

17. The traveling floor cleaning machine as claimed in claim 16, wherein the flow guidance element is seated on the holder.

18. The traveling floor cleaning machine as claimed in claim 16, wherein the flow guidance element comprises a middle element on which the suction unit is at least one of held and supported.

19. The traveling floor cleaning machine as claimed in claim 18, wherein at least one curved flow channel is at least one of arranged and formed on the middle element.

20. The traveling floor cleaning machine as claimed in claim 18, wherein a first connector with an inlet is arranged on the middle element.

21. The traveling floor cleaning machine as claimed in claim 20, wherein a second connector with an outlet is arranged on the middle element.

22. The traveling floor cleaning machine as claimed in claim 21, wherein the first connector and the second connector are oriented transversely to one another.

23. The traveling floor cleaning machine as claimed in claim 21, wherein a closed flow channel is formed on at least one of the first connector and the second connector.

24. The traveling floor cleaning machine as claimed in claim 18, wherein an outlet web is arranged at the middle element.

25. The traveling floor cleaning machine as claimed in claim 16, wherein the flow guidance element is formed in one piece.

26. The traveling floor cleaning machine as claimed in claim 16, wherein the flow guidance element is configured for guiding process air of the suction unit and for guiding motor air.

27. The traveling floor cleaning machine as claimed in claim 1, wherein at least one channel is arranged at the at least one cleaning fluid tank, fluidically connected to the suction unit and is guided through the at least one cleaning fluid tank and is sealed against a receptacle chamber of the at least one cleaning fluid tank.

28. The traveling floor cleaning machine as claimed in claim 27, wherein the at least one channel is fluidically connected to a negative pressure application apparatus, by means of which negative pressure is applicable to a receptacle chamber of the at least one dirty fluid tank.

29. The traveling floor cleaning machine as claimed in claim 1, wherein the suction apparatus comprises a suction unit which is seated on the holder, comprises at least one channel which extends through at least one cleaning fluid tank, comprises a negative pressure application apparatus which is fluidically connected via the at least one channel to the suction unit and by means of which negative pressure is applicable to a receptacle chamber of at least one dirty fluid tank and comprises the aspiration apparatus with at least one vacuum beam which is fluidically connected to the receptacle chamber of the at least one dirty fluid tank.

30. The traveling floor cleaning machine as claimed in claim 1, wherein a delivery apparatus for applying a cleaning fluid onto a floor surface is arranged on the holder.

31. The traveling floor cleaning machine as claimed in claim 1, said traveling floor cleaning machine being configured as a scrubbing machine or a suction machine or a scrubbing-suction machine or a sweeping machine.

32. The traveling floor cleaning machine as claimed in claim 1, said traveling floor cleaning machine being configured as a self-propelling machine.

33. The traveling floor cleaning machine as claimed in claim 1, said traveling floor cleaning machine being configured as a walk-behind machine.

34. A traveling floor cleaning machine comprising:

a chassis;

a cleaning tool apparatus which is arranged on the chassis, with at least one cleaning tool and with a holder for the at least one cleaning tool; and a suction apparatus which comprises a suction unit and an aspiration apparatus;

wherein the suction unit is arranged on the holder;

said traveling floor cleaning machine comprising a flow guidance element with at least one inlet and with at least one outlet, wherein the flow guidance element comprises one or more flow channels with at least one of a curved flow guidance direction and a flow deflection;

wherein the flow guidance element comprises a middle element on which the suction unit is at least one of held and supported.

35. A traveling floor cleaning machine comprising:

a chassis;

a cleaning tool apparatus which is arranged on the chassis, with at least one cleaning tool and with a holder for the at least one cleaning tool; and a suction apparatus which comprises a suction unit and an aspiration apparatus;

wherein the suction unit is arranged on the holder;

said traveling floor cleaning machine comprising a flow guidance element with at least one inlet and with at least one outlet, wherein the flow guidance element comprises one or more flow channels with at least one of a curved flow guidance direction and a flow deflection;

wherein the flow guidance element is formed in one piece.

36. A traveling floor cleaning machine comprising:

a chassis;

a cleaning tool apparatus which is arranged on the chassis, with at least one cleaning tool and with a holder for the at least one cleaning tool; and a suction apparatus which comprises a suction unit and an aspiration apparatus;

wherein the suction unit is arranged on the holder;

said traveling floor cleaning machine comprising a flow guidance element with at least one inlet and with at least one outlet, wherein the flow guidance element comprises one or more flow channels with at least one of a curved flow guidance direction and a flow deflection;

wherein the flow guidance element is configured for guiding process air of the suction unit and for guiding motor air.

37. A traveling floor cleaning machine comprising:

a chassis;

a cleaning tool apparatus which is arranged on the chassis, with at least one cleaning tool and with a holder for the at least one cleaning tool; and a suction apparatus which comprises a suction unit and an aspiration apparatus;

wherein the suction unit is arranged on the holder;

wherein the suction apparatus comprises a suction unit which is seated on the holder, comprises at least one channel which extends through at least one cleaning fluid tank, comprises a negative pressure application apparatus which is fluidically connected via the at least one channel to the suction unit and by means of which negative pressure is applicable to a receptacle chamber of at least one dirty fluid tank and comprises the aspiration apparatus with at least one vacuum beam which is fluidically connected to the receptacle chamber of the at least one dirty fluid tank.

* * * * *